US006176736B1

(12) United States Patent
Hsu

(10) Patent No.: US 6,176,736 B1
(45) Date of Patent: Jan. 23, 2001

(54) CONNECTION BETWEEN A CEILING FAN AND A LAMP

(76) Inventor: Kuang-Hsiung Hsu, P.O. Box 82-144, Taipei (TW)

( * ) Notice: Under 35 U.S.C. 154(b), the term of this patent shall be extended for 0 days.

(21) Appl. No.: 09/277,841

(22) Filed: Mar. 29, 1999

(51) Int. Cl.[7] ..... H01R 13/60; H01R 13/66
(52) U.S. Cl. ..... 439/537; 439/576; 362/94
(58) Field of Search ..... 439/537, 576; 362/294, 404, 410, 96

(56) References Cited

U.S. PATENT DOCUMENTS 1,925,440 * 9/1933 Fabrey ..... 439/576
4,422,824 * 12/1983 Eisenhardt, Jr. ..... 416/5
4,675,663 * 6/1987 Corwin ..... 340/671
4,721,480 * 1/1988 Yung ..... 439/537
4,871,327 * 10/1989 Ridgway et al. ..... 439/576
4,952,157 * 8/1990 Hudson et al. ..... 439/537
5,668,920 * 9/1997 Pelonis ..... 392/361
5,800,049 * 9/1998 Todd, Jr. ..... 362/294

* cited by examiner

*Primary Examiner*—Paula Bradley
*Assistant Examiner*—Katrina Davis
(74) *Attorney, Agent, or Firm*—A & J

(57) ABSTRACT

A connection between a ceiling fan and a lamp includes a bracket being a hollow conical member having an inner side formed with a projection, a notch extending through a side wall off said hollow conical member and two opposite recesses on an outer side of said hollow conical member, a pair of terminals made of insulation material and each provided at one end with a protrusion engaged with said circular hole and at another end with a conducting member extending into a bottom of said bracket, a suspending tube having a lower end for connecting to a lamp, a plug fitted inside said bracket, and two electrical wires extending upwardly out of an upper end of said suspending tube and then bent downwardly to go through said plug to contact respective conducting members of said terminals.

1 Claim, 6 Drawing Sheets

CONNECTION BETWEEN A CEILING FAN AND A LAMP

BACKGROUND OF THE INVENTION

1. Field of the Invention

This invention is related to an improvement in the structure of a connection between a ceiling fan and a lamp.

2. Description of the Prior Art

As shown in FIG. 1, the conventional connection between a ceiling fan 10 and a lamp 20 is accomplished by first dismantling a bottom cover 12 from a junction box 11, locking the bottom cover 12 on the susension tube 21 of the lamp 20, and then mounting a bell-shaped cover 22 over the suspension tube 21 of the lamp 20. However, it is necessary to hold the lamp 20 and move it to be close to the bottom of the junction box 11 of the ceiling fan 10 with one hand so as to enable the electrical cords 13 and 23 of the ceiling fan and the lamp 20 to be correctly connected, and then threadedly engage the lamp 20 with the lower portion of the junction box 11 of the ceiling fan 10, thereby causing much difficulty and inconvenience in operation.

Therefore, it is an object of the present invention to provide an improved connection between a ceiling fan and a lamp which can obviate and mitigate the above-mentioned drawbacks.

SUMMARY OF THE INVENTION

This invention is related to an improvement in the structure of a connection between a ceiling fan and a lamp.

It is the primary object of the present invention to provide an improvement in the structure of a connection between a ceiling fan and a lamp which can be readily assembled.

It is another object of the present invention to provide an improvement in the structure of a connection between a ceiling fan and a lamp which can be easily dismantled.

It is still another object of the present invention to provide an improvement in the structure of a connection between a ceiling fan and a lamp which is simple in construction.

It is still another object of the present invention to provide an improvement in the structure of a connection between a ceiling fan and a lamp which is low in cost.

It is a further object of the present invention to provide an improvement in the structure of a connection between a ceiling fan and a lamp which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
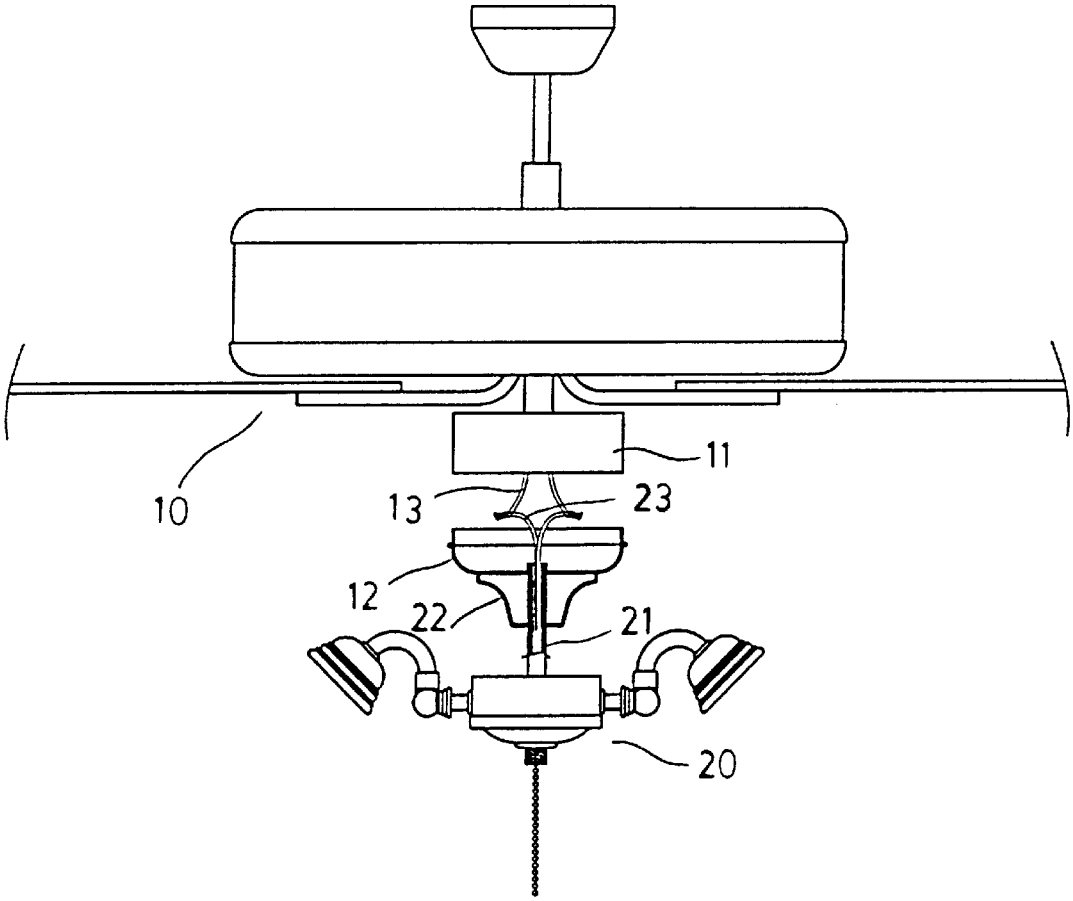
FIG. 1 is an exploded view showing a prior art connection between a ceiling fan and a lamp.
Figure 2:
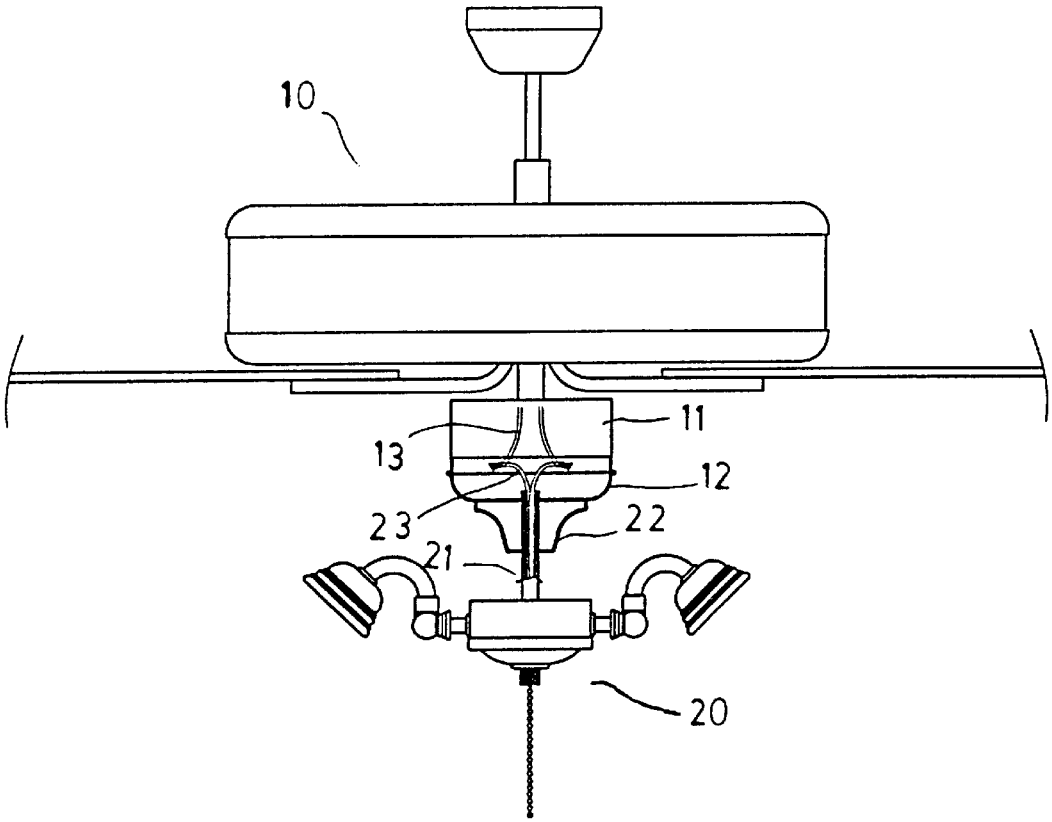
FIG. 2 illustrates the prior art connection between the ceiling fan and the lamp.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
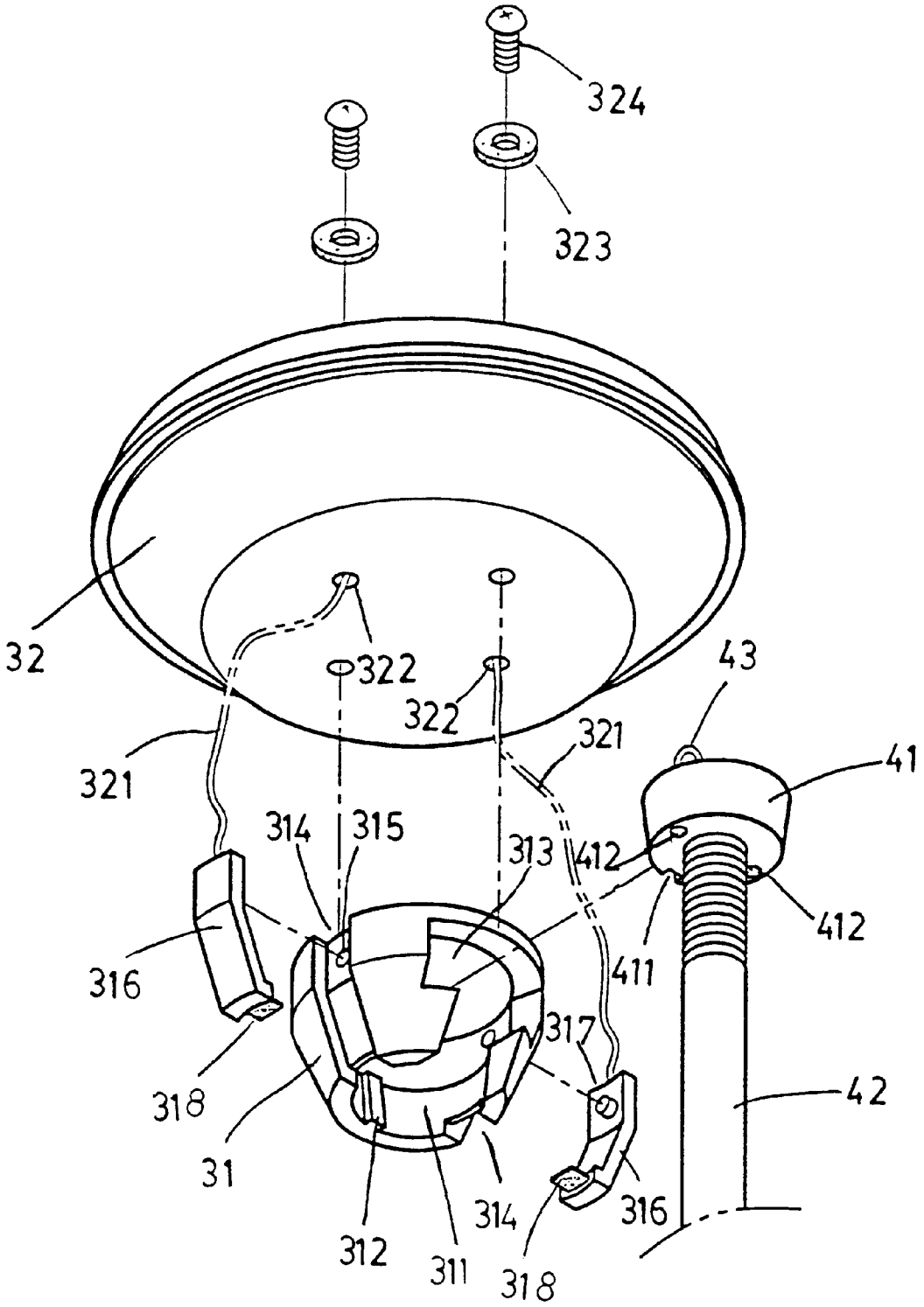
FIG. 3 is an exploded view of the present invention.
Figure 6:
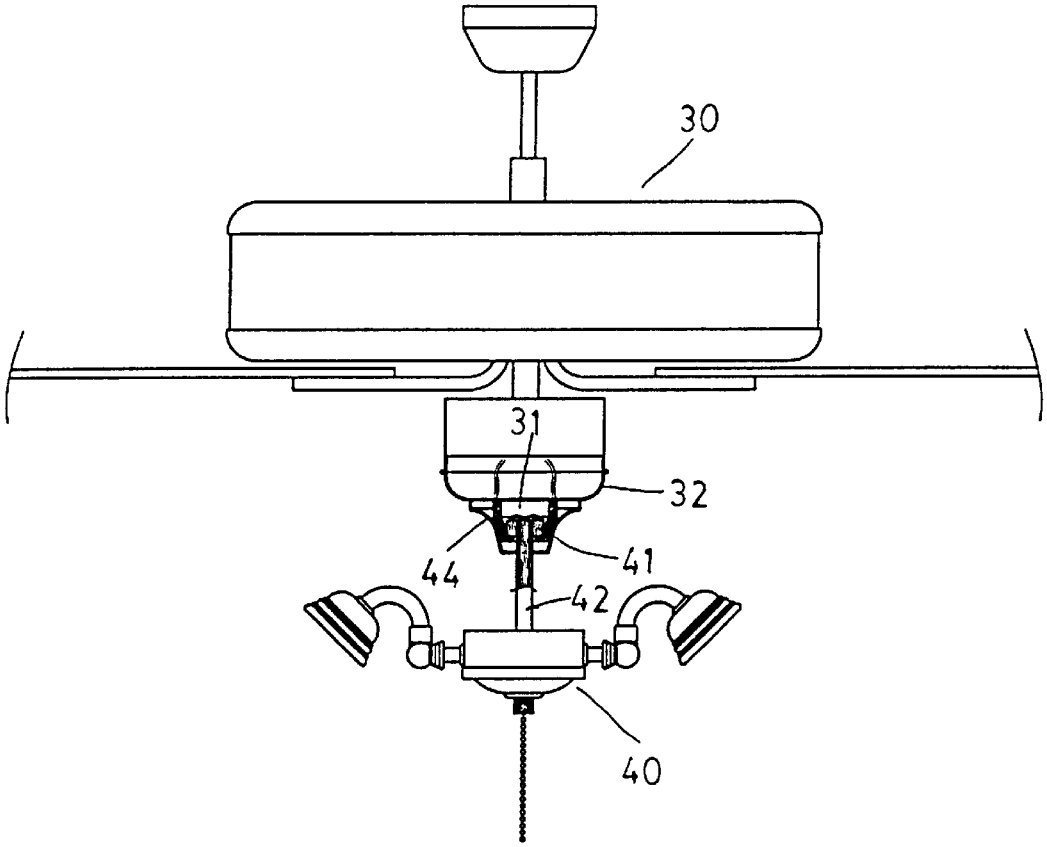
FIG. 6 is a working view of the present invention.

With reference to the drawings and in particular to FIGS. 3 and 6, the connection according to the present invention is applied to connect a lamp 40 to a ceiling fan 30. The connection according to the present invention generally comprises a bracket 31 and a suspending member 41.

The bracket 31 is a hollow conical member having an inner side 311 formed with a projection 312, a notch 313 extending through the side wall of the hollow conical member, and two opposite recesses 314 on the outer side of the hollow conical member. Each of the opposite recesses 314 is formed with a circular hole 315. A terminal 316 is fitted in each of the opposite recesses 314.

The terminal 316 is made of insulation material and provided with a protrusion 317 at one end and a conducting member 318 at another end. The terminal 316 is fitted in each of the recesses 314 with the protrusion 317 engaged with the circular hole 315 and the conducting member 318 extending into the bottom of the bracket 31.

The suspending member 41 is fixedly mounted on the upper end of a suspending tube 42 the lower end of which is connected with a lamp (not shown). The suspending member 41 is a conical member configured to fit inside the bracket 31 so that the former will not fall out of the latter. Furthermore, the outer conical side of the suspending member 41 is formed with a groove 411 which is configured to engage with the projection 312 of the bracket 31 for preventing the suspending member 41 from rotating with respect to the bracket 31. Two electrical wires 43 (see FIGS. 3,4 and 5) extend upwardly out the upper end of the suspending tube 42 and then bend downwardly to go through a plug within the suspending member 41 to cause their lower ends 412 to contact respective conducting members 318 ofthe terminals 316.

Figure 4:
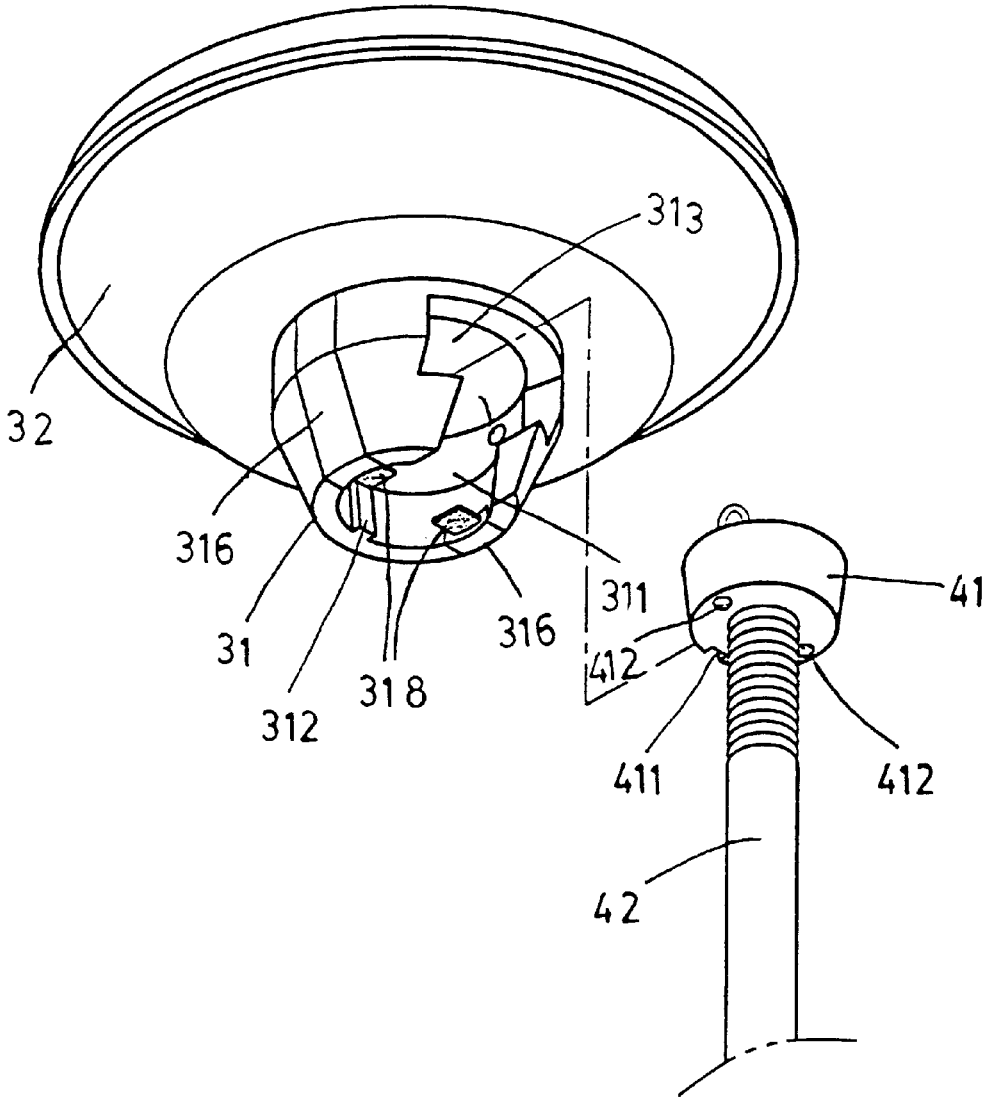
FIG. 4 is another exploded view of the present invention.

Referring to FIGS. 3 and 4, when in assembly, two power wires 321 are extended downwardly out of two holes 322 of a cover 32 from a ceiling fan 30 (see FIG. 6) and then extended through the terminals 316 to solder on the conducting members 318 of the terminals 316. Thereafter, the conducting members 318 are fitted partially into lower ends of the terminals 316. Then, the terminals 316 are fitted in the opposite recesses 314 of the bracket 31, with the protrusion 317 engaged with the circular hole 315 and the conducting member 318 extending into the bottom of the bracket 31. Thereafter, the bracket 31 is locked on the cover 32 by washers 323 and screws 324.

Figure 5:
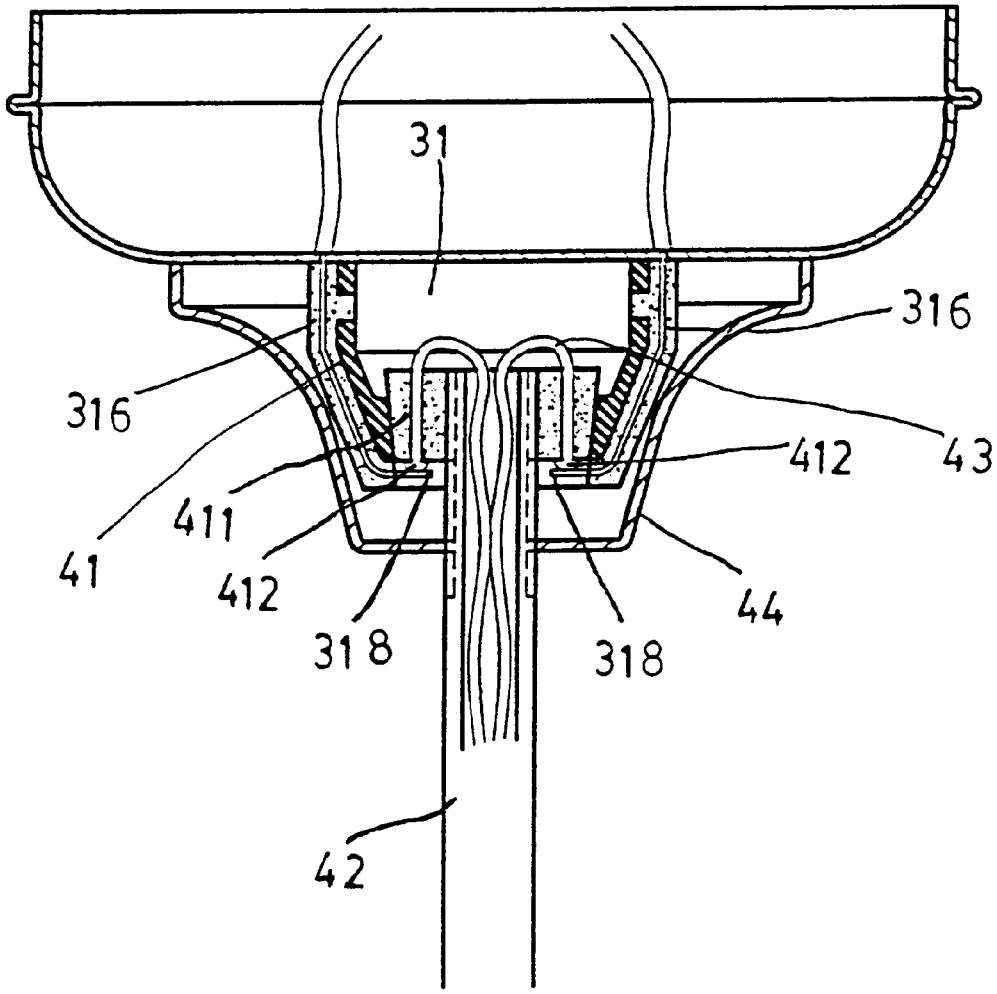
FIG. 5 is a sectional view of the present invention.

As shown in FIGS. 4,5 and 6, when desired to mount a lamp 40 under the ceiling fan 30, simply fit the suspending member 42 inside the bracket 31 from the notch 313 so that the groove 411 of the suspending member 41 is engaged with the projection 312 of the bracket 31 and the lower ends 412 of the electrical wires 413 are in contact with the conducting members 318 of the terminals 316.

The bell shaped cover 44 shown in FIG. 6 is mounted on the bottom of the cover 32 by any means well known to the art and is not considered a part of the invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electrical connection between a ceiling fan and a lamp comprising:

a bracket attached to a cover of said ceiling fan, said bracket being a hollow conical member having an inner side formed with a projection formed on an inner side thereof, a notch extending through a side wall of said hollow conical member and two opposite recesses on an outer side of said hollow conical member, each of said recesses having a circular hole formed therein;

a pair of terminals made of insulative material which extends from a cover member are each provided with a protrusion at one end of said terminal and with a conducting member extending at an opposite end of said terminal, said protrusion of said terminal engages with said circular hole in the recesses of said bracket and said conducting member extends into a bottom of said recesses of said bracket;

a suspending member is fixedly mounted on an upper end of a suspending tube having a lower end for connecting to a lamp, said suspending member being conical shaped and configured to fit inside said bracket through said notch, said suspending member having an outer side formed with a groove configured to engage with said projection of said bracket for preventing said suspended member from rotating with respect to said bracket; and two electrical wires extending upwardly out of an upper end of said suspending tube and bent downwardly, a lower end of said two electrical wires is disposed at a bottom of said suspending member to contact respective conducting members of said terminals.

* * * * *